United States Patent [19]

Murao

[11] 4,028,776

[45] June 14, 1977

[54] SWINGING INTERMITTENT DRIVE REVOLVING CLEARER

[76] Inventor: Yoshio Murao, 55, Masuizumimati Kanazawa Ishikawa, Japan

[22] Filed: Jan. 30, 1974

[21] Appl. No.: 437,864

[30] Foreign Application Priority Data

May 29, 1973 Japan ..... 48-63177

[52] U.S. Cl. ..... 19/265; 19/232

[51] Int. Cl.[2] ..... D01H 5/60

[58] Field of Search ..... 19/262, 264, 265, 232, 19/229, 231, 226, 227, 228; 15/256.51, 256.53, 256.5

[56] References Cited

UNITED STATES PATENTS

| | | | |
|---|---|---|---|
| 1,351,076 | 8/1920 | Tunstall | 19/226 |
| 2,353,812 | 7/1944 | Crockett | 19/225 X |
| 2,673,375 | 3/1954 | Snyder | 19/232 X |
| 2,741,802 | 4/1956 | Preston | 19/265 X |

FOREIGN PATENTS OR APPLICATIONS

| | | | |
|---|---|---|---|
| 324,530 | 1/1930 | United Kingdom | 19/265 |

*Primary Examiner*—Dorsey Newton
*Attorney, Agent, or Firm*—Darby & Darby

[57] ABSTRACT

An intermittent drive revolving clearer for drafting rollers that moves to avoid the motion of a top comb thereby permitting continuous cleaning of the drafting rollers resulting in high efficiency cleaning and improved yarn quality. A knife edge removes the waste material from the continuous clearer cloth without mixing the clearer waste material with the sliver, thereby permitting continuous operation of the clearer for long periods of time.

3 Claims, 1 Drawing Figure

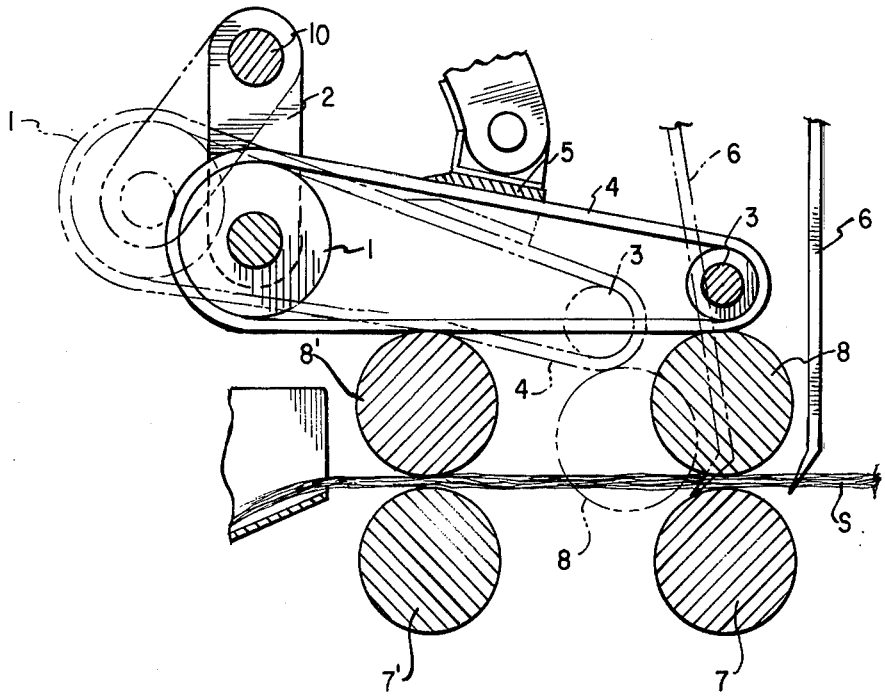
10
2
1
5
6
4
3
6
1
3
8'
8
4
S
8
7'
7

SWINGING INTERMITTENT DRIVE REVOLVING CLEARER

In a drafting operation, the fibers begin in a loose and soft strand, called a sliver, and pass between a series of pairs of drafting rollers, each pair rotating more rapidly than the preceding pair, which draw the fibers out and make them more nearly parallel. The drafting process results in the removal of flies and short fibers from the sliver and these waste materials collect on the drafting rollers. A device known as a clearer, removes flies and fibers from the drafting rollers. This is desirable since inferior yarn will be produced if this waste material is again mixed with the sliver and the uniformity of the sliver will be lessened.

Prior to the drafting operation, the sliver may be combed resulting in the removal of some waste material and placing the fibers in a more nearly parallel condition. In the combing operation, the sliver is held in place and a top comb moves lengthwise through a portion of the sliver. The top drafting roller nearest the top comb also moves to avoid contact with the top comb.

There are number of known clearer constructions. Particularly desirable is a clearer which includes a revolving endless cloth which is urged against the drafting rollers. However, known clearers of this type have not previously been used with textile machines including combing means because they interfere with the combing mechanism. Furthermore, known revolving clearers are not capable of continuous operation with drafting rollers when they are positioned for combing operation.

Accordingly, it is an object of the present invention to provide a revolving clearer capable of continuously cleaning the drafting rollers of a textile machine even when the rollers are moved during a combing operation.

It is a further object of the present invention to provide a revolving clearer that continuously cleans waste from drafting rollers and is itself cleaned of the clearer waste in such a manner that the waste is not mixed with the sliver, thereby permitting operation of the machine while the clearer cloth is being cleaned.

According to the invention, a revolving clearer is mounted on a pivotable arm that permits the clearer to move as the top drafting roller and the top comb move. The clearer cloth maintains continuous contact with the drafting rollers without interfering with the motion of the top comb. A knife edge, mounted on the top side of the clearer, and in close proximity to the clearer cloth, continuously removes waste from the clearer cloth in such a manner that the waste does not become mixed with the roving. Thus, the machine need not be stopped while the clearer cloth is cleaned.

The above and other objects and features of the present invention will become apparent to one skilled in the art from the consideration of the attached drawing.

In the drawing there is shown a side elevation view partly in section of the clearer apparatus, drafting rollers and top comb of the present invention. It should be understood that the opposite side of the clearer is a mirror image of that which is shown in the drawing.

The slivers pass through top comb 6 and then between two pairs of drafting rollers 7, 8 and 7′, 8′. All of the rollers except 8 are rotatable journalled in the machine at their respective ends. Roller 8 is rotatably mounted at both ends to arms (not shown) that are pivotally mounted to the machine. The mounting means for the drafting rollers is not shown and does not form part of the present invention.

A top comb 6 is also movably mounted to the machine (not shown). In the combing process, the slivers proceed first through the top comb 6 and then through the drafting rollers 7 and 8 and 7′ and 8′. Combing is performed as top comb 6 moves from its initial position as shown by the solid lines to the position shown by the phantom lines and thus proceeds lengthwise along the sliver. When comb 6 moves, roller 8 moves from its initial position as shown by the solid lines to the position shown by the phantom lines. The operation as so far described is known.

The combing operation straightens the fibers and places them more nearly parallel to each other. The high degree of parallelism obtained means that the shorter and waste fibers can fall out of the slivers during the drafting operation and onto drafting rollers 7, 8, 7′ and 8′. These flies and waste fibers should be removed from drafting rollers so that they do not get into the slivers again and reduce its uniformity and the quality of the yarn that is ultimately produced.

The necessary cleaning action is provided by a clearer having an endless clearer cloth 4 which moves around rollers 1 and 3 and maintains contact with the drafting rollers 8 and 8′ to perform the actual cleaning. Any conventional type of clearer cloth fabric may be used. Rollers 1 and 3 are rotatably mounted at their respective ends to plates (not shown) that form the ends of the clearer. The mounting means do not form part of the present invention and are not shown.

The power to drive clearer cloth 4 is transmitted to the cloth from the machine by means, such as are described in U.S. patent application Ser. No. 437,865 (att. Dkt. No. TOY5/PO559) application filed concurrently with this application in the name of Murao. These means cause roller 1 to rotate intermittently.

According to the invention, clearer roller 1 is rotatably supported in the bottom portions of two spaced arms 2 which are pivotally attached at their upper ends to the textile machine by axles 10.

In the initial position as shown by the solid lines, the clearer cloth is in contact with rollers 8 and 8′. A mechanism (not shown and not part of the present invention) permits adjustment of the pressure exerted by the clearer cloth on the rollers. During the combing operation, as roller 8 moves, the clearer assembly pivots about axle 10 and moves from its initial position as indicated by the solid lines to the position shown by phantom lines. During the time of movement, clearer cloth 4 maintains contact with rollers 8 and 8′, and the clearer does not interfere with the motion of top comb 6. Movement of the clearer assembly may be caused by gravity alone, or a power assist may be provided if desired. A knife edge 5, with its ends rigidly mounted to the ends of the clearer assembly, is positioned on the top side of the clearer and in close proximity to clearer cloth 4. Accordingly, when the clearer assembly swings, knife edge 5 also moves and maintains the same position with respect to clearer cloth 4. The knife edge removes clearer waste from clearer cloth 4. The position of knife edge 5 with respect to clearer cloth 4 can be adjusted (means not shown) depending upon the condition of the clearer cloth 4 and the type of fiber passing through the drafting rollers.

An additional clearer (not shown) is needed to clean the bottom rollers 7 and 7′. However, this clearer does not have to move as it does not interfere with the movement of either roller 8 or top comb 6.

It can be seen that a revolving clearer has been provided for top drafting rollers in a textile machine used in conjunction with a combing operation. The revolving clearer moves to avoid interfering with the motion of the top comb and maintains continuous contact with the top drafting rollers. A knife edge removes the waste material from the clearer cloth without again mixing it with the slivers. Thus, the clearer provides continuous action for the top drafting rollers without the necessity for stopping the textile machine to clean the clearer cloth.

What is claimed is:

1. A revolving clearer for cleaning the upper drafting rollers of a textile machine wherein at least one of said drafting rollers is movable during a combing operation, wherein a top comb and said one drafting roller move in the same general direction, comprising:

first and second rollers;

an endless clearer cloth around said first and second rollers, said clearer cloth adapted to engage both of said upper drafting rollers; and a pair of spaced arms pivotally connected at their upper ends to the textile machine, one of said first and second rollers being rotatably supported in the lower portions of said arms.

2. Apparatus according to claim 1 wherein said clearer rests on top of said movable drafting roller and remains in contact therewith as said movable roller is positioned to enable a combing operation.

3. Apparatus according to claim 2 including a knife edge adapted to engage a surface of said clearer cloth to remove waste material therefrom.

* * * * *